US006035777A

United States Patent [19]

King

[11] Patent Number: 6,035,777

[45] Date of Patent: Mar. 14, 2000

[54] PROCESS OF TRANSFERRING A SUBLIMATION INK IMAGE TO A FLOWER POT

[76] Inventor: Theresa A. King, 1352 Middlesex Ave. NE., Atlanta, Ga. 30306

[21] Appl. No.: 09/225,602

[22] Filed: Jan. 6, 1999

Related U.S. Application Data

[60] Provisional application No. 60/070,716, Jan. 7, 1998.

[51] Int. Cl.[7] ..... B41C 1/06; B41F 17/28

[52] U.S. Cl. ..... 101/34; 101/41; 101/488

[58] Field of Search ..... 101/33, 34, 35, 101/41, 488

[56] References Cited

U.S. PATENT DOCUMENTS

| | | | |
|---|---|---|---|
| 4,059,471 | 11/1977 | Haigh | 101/34 |
| 4,397,710 | 8/1983 | Gaylord | 101/33 |
| 5,170,704 | 12/1992 | Warren et al. | 101/41 |
| 5,324,378 | 6/1994 | Sieber | 101/34 |
| 5,337,670 | 8/1994 | Huang | 101/34 |
| 5,443,001 | 8/1995 | Keller, III et al. | 101/35 |
| 5,487,614 | 1/1996 | Hale | 400/120.02 |
| 5,832,819 | 11/1998 | Widman | 101/33 |

*Primary Examiner*—John Hilten
*Assistant Examiner*—Leslie J. Grohusky
*Attorney, Agent, or Firm*—Handal & Morofsky

[57] ABSTRACT

Transferring a sublimation ink image to the surface of an object by forming a plurality of conically shaped objects from a master cast. Coating the objects with an organic polymer. Casting a heat transfer block to match a portion of the exterior surface of then object. Printing an image with a sublimation ink onto a release paper. Manipulating the image to accommodate the configuration of the objects. Placing the image on one the objects and introducing heat and pressure to the image and the release paper through said block to effect the transfer of the image to the object.

7 Claims, 12 Drawing Sheets

PROCESS OF TRANSFERRING A SUBLIMATION INK IMAGE TO A FLOWER POT

This application claims the benefit of U.S. Provisional No. 60/070,716 filed Jan. 7, 1998.

BACKGROUND OF THE INVENTION

The present invention relates to the heat transfer of images, and more particularly the heat transfer of images to a conventional frustro-conical flower pot.

Personalized cups, mugs, glasses and other tubular structures have become increasingly popular over the past few years, especially as a specialty gift and/or as advertising devices.

Such items are often created through the use of heat transfer imaging. This process involves the generation of an image in the form of a sublimation ink printout which, when exposed to heat and relatively low mechanical pressure, results in causing the sublimation ink to enter the gaseous state and to be transferred to the object to be personalized before returning to its non-gaseous state.

More particularly, the image to be transferred through this sublimation process is printed first with a sublimation ink onto a transfer paper or a release paper. The image is generated on this paper, which serves as a temporary carrier for the image, in the form of a mirror image of the image which one desires to imprint on the flower pot. This is because, when the image is transferred onto the surface of an object, the reverse side of the sublimation image is exposed, thus rendering the image with the correct orientation for viewing.

As alluded to above, the sublimation heat transfer process involves the transferring of a sublimation ink image through the incorporation of heat and contract pressure. A sublimation ink image can be generated by a copy machine, laser printer, and/or a printing press. However, in all of these cases, the images must be generated with sublimation ink. The sublimation ink print output by such a printer is made up of two basic parts: a transfer release paper and a layer of that usually various colored pigments arranged as a matrix of pixels about different colors to define in image which one wishes to have on the object to be printed. The sublimation ink is printed onto the transfer release paper as would any type of colored or black pigment be printed by a computer printer. As noted above the image is printed as a mirror image of the final image so as to effect the desired display when the image is transferred.

Once the image formed by the sublimation ink has been printed on the transfer paper, it is ready for transfer. The heat transfer process involves putting the sublimation ink image into intimate contact with the object to be printed, while simultaneously heating up the sublimation ink to a temperature at which the ink enters the gaseous stage. The vaporized inks are thus caused to be freed from the transfer paper and pass to a coating on the object to which the image is to be transferred. The ink then adheres to the coating on the object.

The heat transfer process heats the transfer paper and sublimation ink to a required temperature (approx. 400 degrees Fahrenheit). As the temperature of sublimation ink approaches this temperature, the sublimation ink will start to release from the transfer paper and will be transmitted to the coating on the object.

SUMMARY OF THE INVENTION

One aspect of the present invention is to solve the problem of transferring such an image to a conical object such as a flower pot. For instance, a typical flower pot has a conical shape wherein the lower portion of the pot has a smaller diameter than the upper portion. This configuration presents several problems, for example, typical heat presses are configured to transfer images to objects having a cylindrical configuration such as coffee mugs and glasses. When an object having a conical shape, such as a flower pot, is portioned with these presses the press is unable to supply uniform heat and pressure to the surface of the flower pot having a conical shape.

Also in accordance with the present invention, the image is modified so that realism is enhanced, despite the conical shape of the flower pot.

The invention also addresses the problems caused by the fact that flower pots have their own unique characteristics in that no two pots are the same. These and other problems make it impossible to reliably achieve a quality print on ordinary flower pots. Each pot has a different surface configuration, wall thickness, ceramic composition, physical dimensions (inside and outside diameter), slopes, angles, curves, and/or overall uniformity.

Even differences which are almost unnoticeable from a cursory inspection can be quite important during execution of the heat transfer process.

In order to print using the aforementioned heat transfer process, a properly prepared transfer image must be held in tight contact with the receiving surface while heat is applied. The heat and pressure must continue for a sufficient time to allow the sublimation processes to complete itself.

A still further problem associated with the prior art has to do with the natural difficulty associated with trying to apply an even pressure between all points of a conical surface and the heating unit. This problem is compounded by the natural tendency of the surfaces of flower pots to form voids. The present invention wraps around the conical object and applies even pressure from all points, while at the same time achieving this in a manner which minimizes the formation of voids. If there is not even pressure this will tend to create darker images in the areas of high pressure and lighter images in the areas of lighter pressure. If there are voids, more serious problems will be created.

In view of the foregoing disadvantages inherent in the known methods and devices, the present invention provides an improved heat transfer press and process for flower pots. As such the general purpose of the present invention, which will be described in detail below, is to provide a new and improved heat transfer press for flower pots which will allow reliable and repeatable sublimation ink transfer printing onto the flower pot.

To achieve these objectives, the present invention provides a press which has been cast to match a flower pot having a conical surface. Moreover, the pot is made from a plaster cast which itself is formed to match the shaped press. The flower pot is also formed through a process which removes irregularities and imperfections, which may appear to be minor, when viewed with the naked eye. However, in accordance with the invention, it has been discovered that these irregularities and/or imperfections in the surface of the flower pot, are magnified in the heat transfer process.

In addition, the surface of the flower pot is coated with a uniform coating of an organic polymer to which the image is transferred, e.g. a clear, film forming polymer such as a polyurethane.

The present invention thus provides a system to substantially and permanently fix indicia onto the surface of conical structures and containers such as flower pots, using sublimation dyes, inks and the like.

BRIEF DESCRIPTION OF THE DRAWINGS

One way of carrying out the invention is described in detail below with reference to drawings which illustrate only one specific embodiment of the invention, in which.

DETAILED DESCRIPTION OF THE BEST MODE

Figure 1:
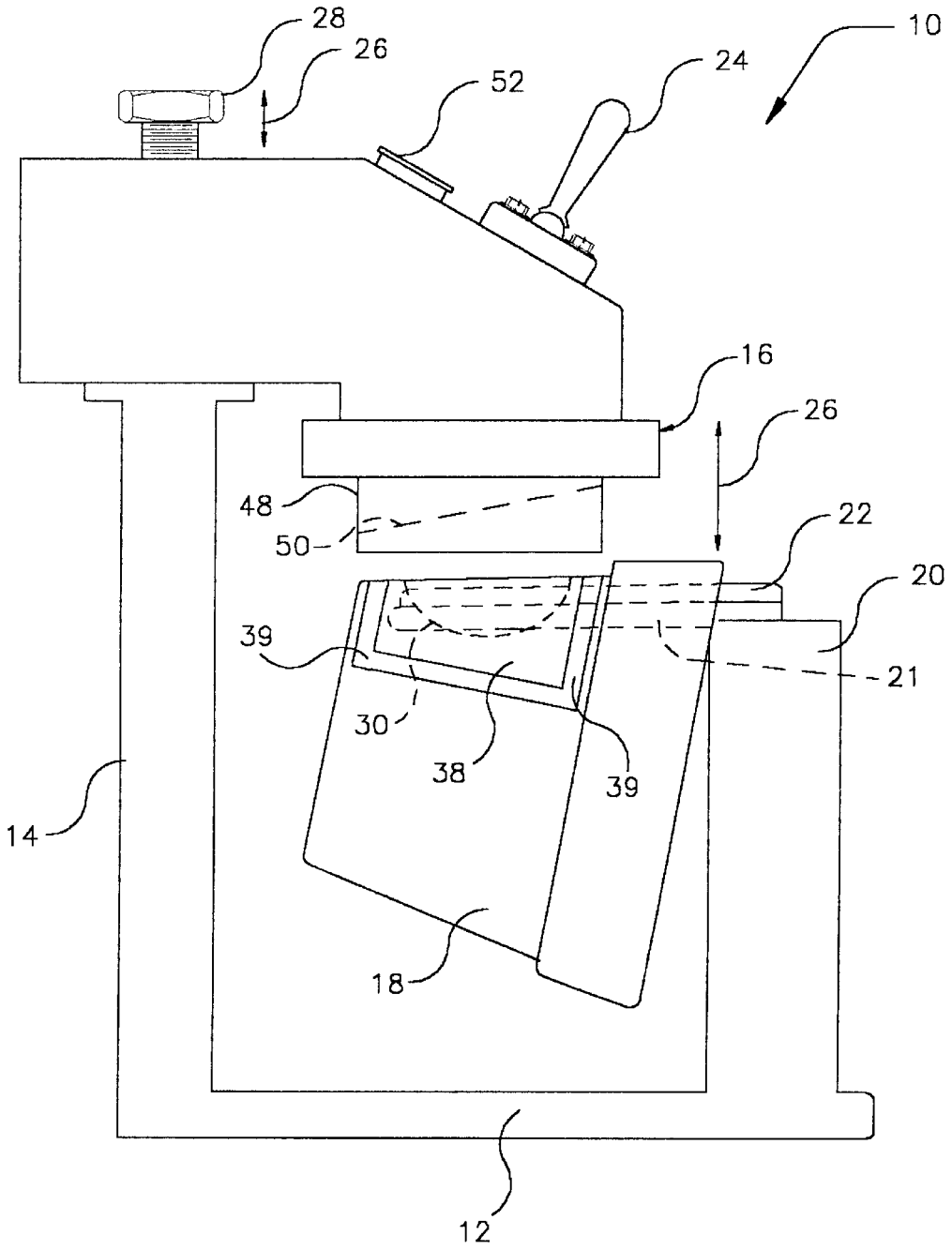
FIG. 1 is a side view of an apparatus useful for practicing the method of the present invention to manufacture and imprinted flower pot constructed in accordance with the invention.
Figure 2:
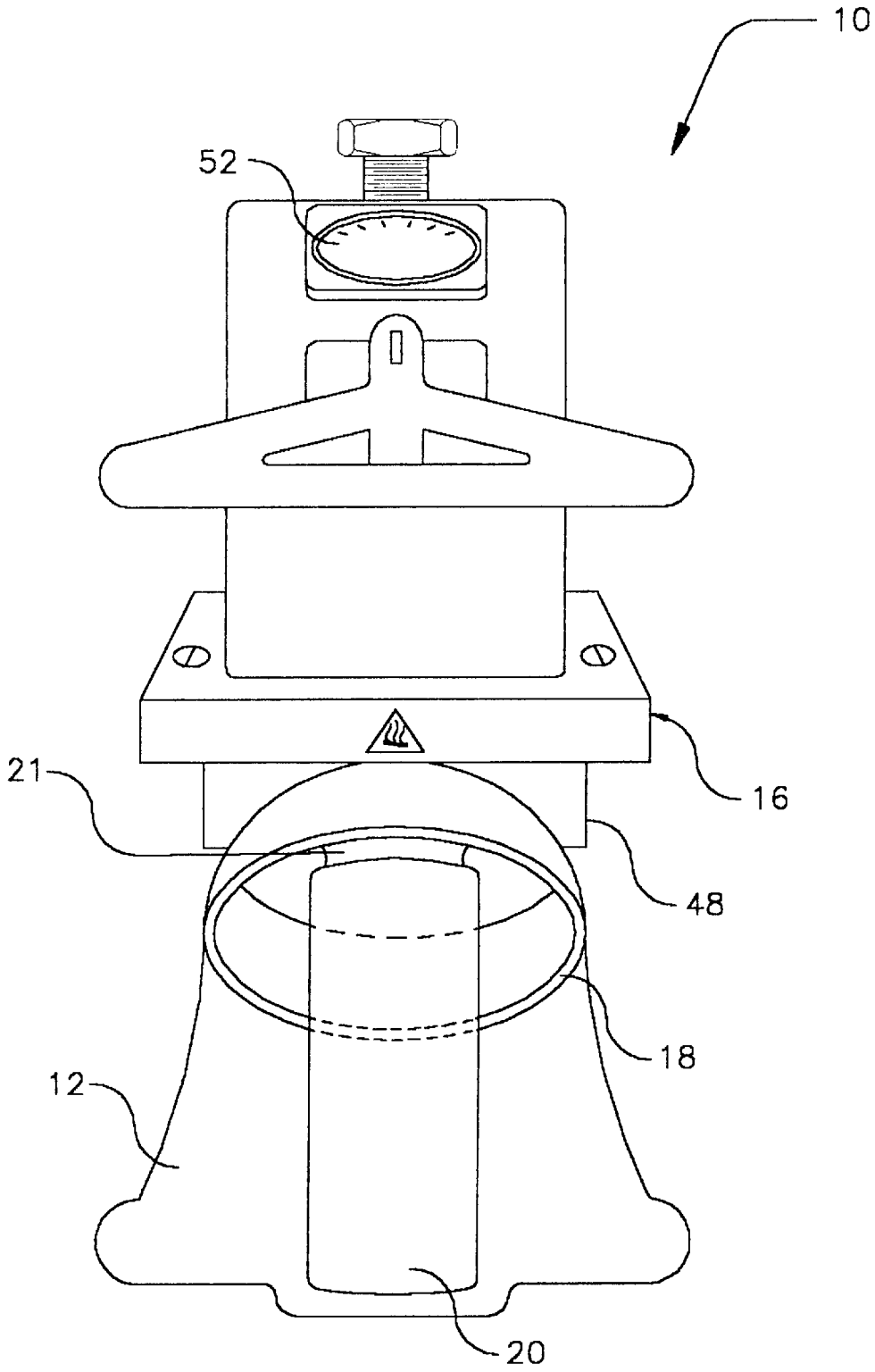
FIG. 2 is a front plane view of the apparatus illustrated in FIG. 1.

Turning now to FIGS. 1 and 2, a heat press 10 constructed in accordance with the present invention is illustrated. Press 10 has a base plate 12. Plate 12 is connected to a support arm 14. Support arm 14 supports the components of the heat press and, more particularly, a heat transfer block 16.

A support rod 20 is positioned to support a flower pot 18. A supporting arm 21 extends outwardly from the upper portion of support rod 20. Flower pot 18 is received by press 10 and is supported along its axis by a supporting arm 21 and rod 20. A compressible rubber member or sponge 22 is positioned between the inner surface of pot 18 and supporting arm 21 and rod 20.

A lever 24 performs the function of providing for the movement of heat transfer block 16 in the direction of arrows 26. This movement allows for heat transfer block 16 to make contact with the surface of flower pot 18 and apply both heat and pressure to the surface of pot 18 while supporting arm 21 and rod 20 and sponge 22 supply an opposing force to facilitate the contact between pot 18 and heating block 16.

Figure 1A:
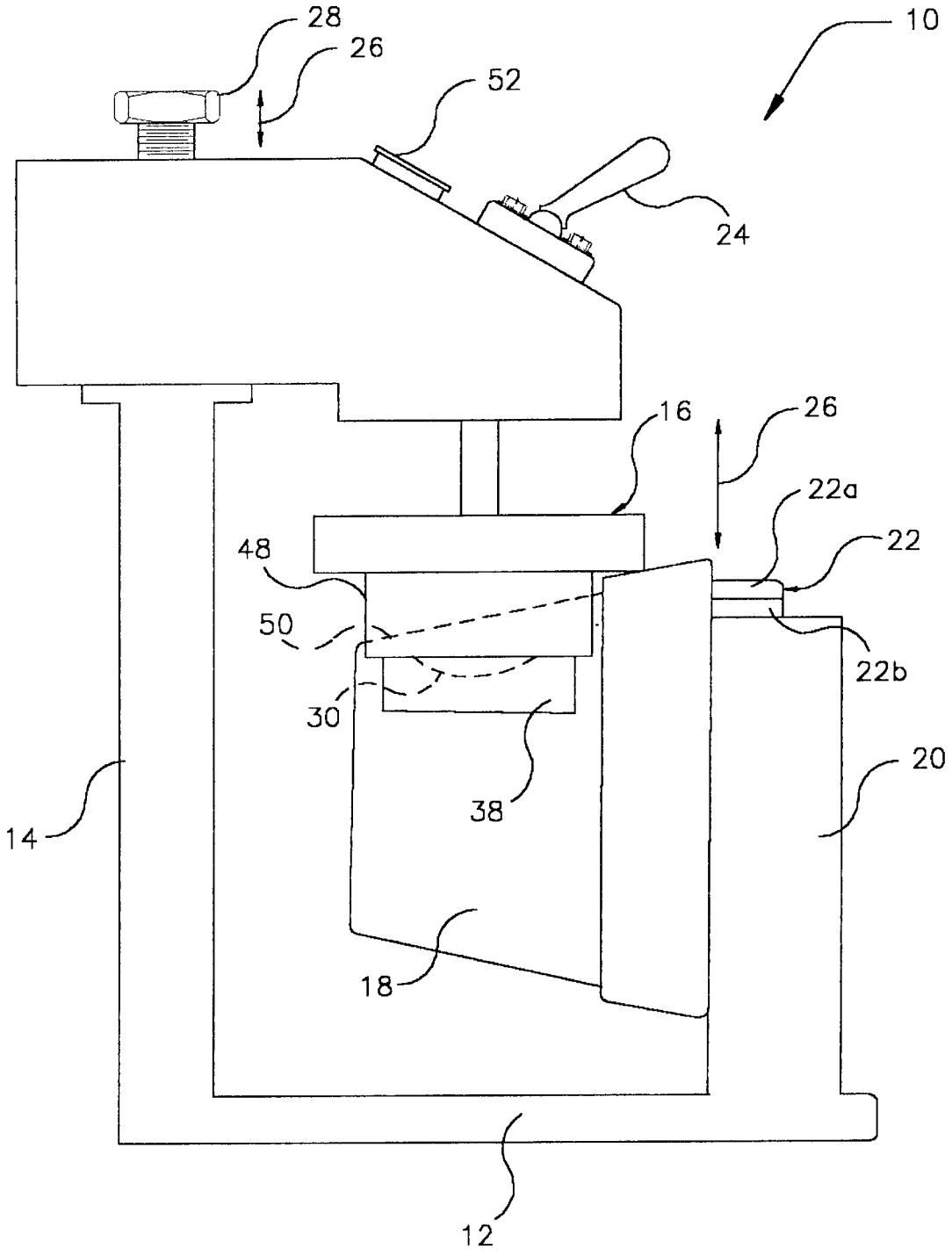
FIG. 1A is a side view of an apparatus useful for practicing the method of the present invention to manufacture and imprinted flower pot constructed in accordance with the invention.
Figure 1B:
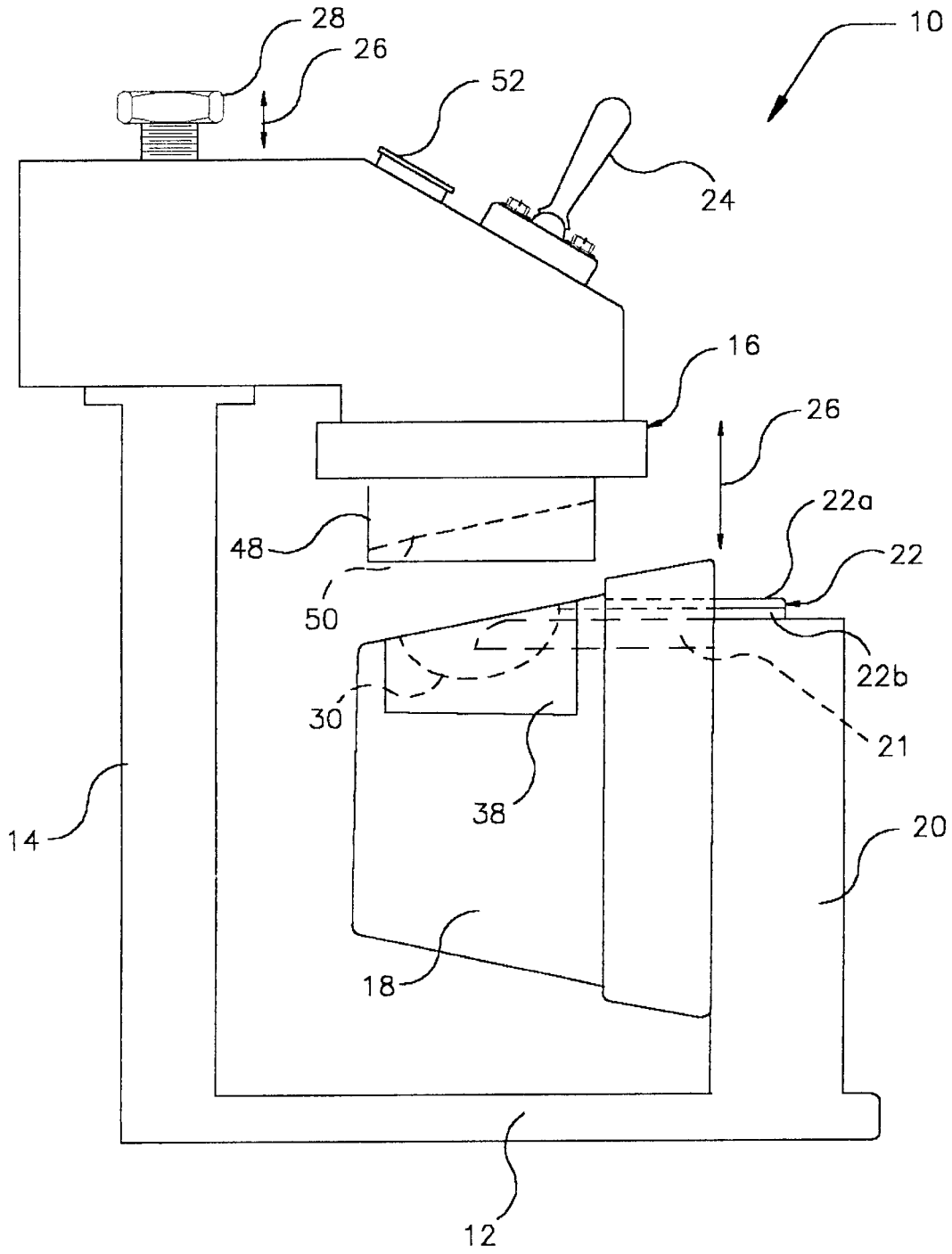
FIG. 1B is a side view of an apparatus useful for practicing an alternative method of the present invention to manufacture and imprinted flower pot constructed in accordance with the invention.

As can be seen in FIG. 1A, as block 16 and its components (which will be discussed in more detail below) moves towards and makes contact with pot 18, pot 18 is moved from its original resting position (as illustrated in FIG. 1) to a position wherein pot 18 is positioned to receive a uniform amount of heat and pressure from heating block 16 (and its components).

Alternatively, supporting arm 21 can be configured to support pot 18 along an axis that is parallel to both heating block 16 and its components.

Figure 1C:
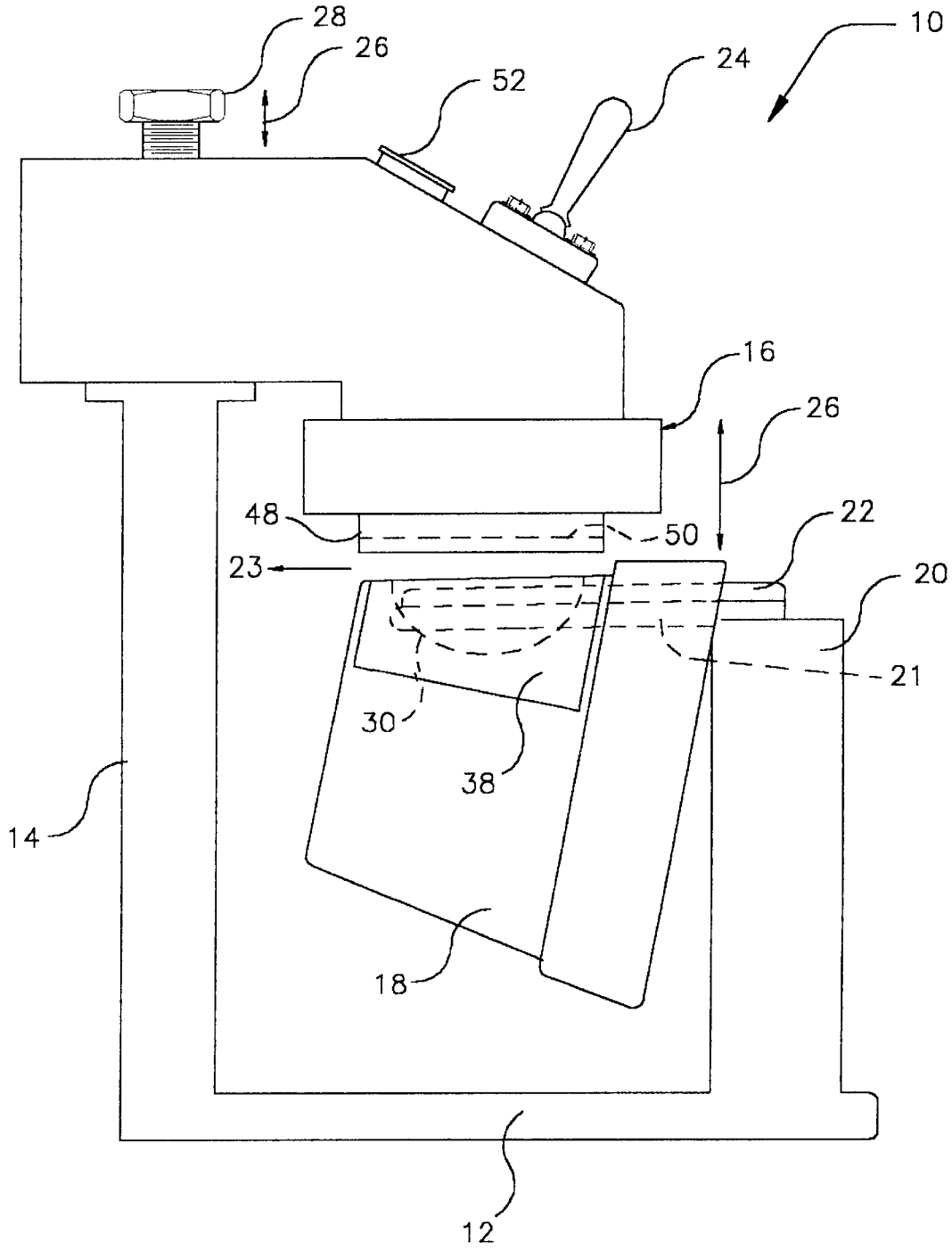
FIG. 1C is a side view of an apparatus useful for practicing an alternative method of the present invention to manufacture and imprinted flower pot constructed in accordance with the invention.

In yet another embodiment and as illustrated in FIG. 1C, supporting arm 21, Rod 20 and/or sponge 22 can be configured to support pot 18 in such a manner that the surface of pot 18 is parallel to heating block 16 and its components so that as the surface of pot 18 makes contact with heating block 16 and its components there is a minimal force in the direction of arrow 23.

A larger force in the direction of arrow 23, is likely to cause slippage of the image during transfer, such slippage is likely to cause defects in the final image transfer.

Sponge 22 is approximately ⅜" thick and made out of a heat resistant silicone sponge rubber having a medium density, as that term is used in the industry. Sponge 22 can vary in size to accommodate pots having various sizes and inside diameters. Lever 24 also performs the function of providing for the movement of heating block 16 away from flower pot 18 once the image transfer process is complete.

Alternatively, sponge 22 can be made out of an upper layer 22*a* and a lower layer 22*b*. In this embodiment, upper layer 22*a* is made out of a heat resistant silicone sponge rubber while lower layer 22*b* is made out of a non--heat resistant sponge rubber.

Alternatively, sponge 22 and supporting arm 21 and rod 20 may be configured to match the interior conical shape of pot 18 to allow for a more uniform opposing force.

In yet another variation, supporting arm 21 and rod 20 can be cast to match the interior surface of pot 18. Such a casting would allow for pot 18 to be supported in an orientation wherein the surface of pot 18 which is to receive heat and pressure from block 16 and its components is in a parallel orientation with respect to block 16. Accordingly, pot 18 is supported in a positioned wherein the movement of block 16 only needs to be facilitated in the directions of arrows 26.

An adjustment knob 28 also allows the user to manipulate press 10 in the directions of arrows 26. This movement allows press 10 to be preset to accommodate objects of various sizes that may be out of the range as defined by the movement of block 16. In addition, rod 20 may be also manufactured to allow for the movement of rod 20 in the directions of arrows 26.

Figure 3:
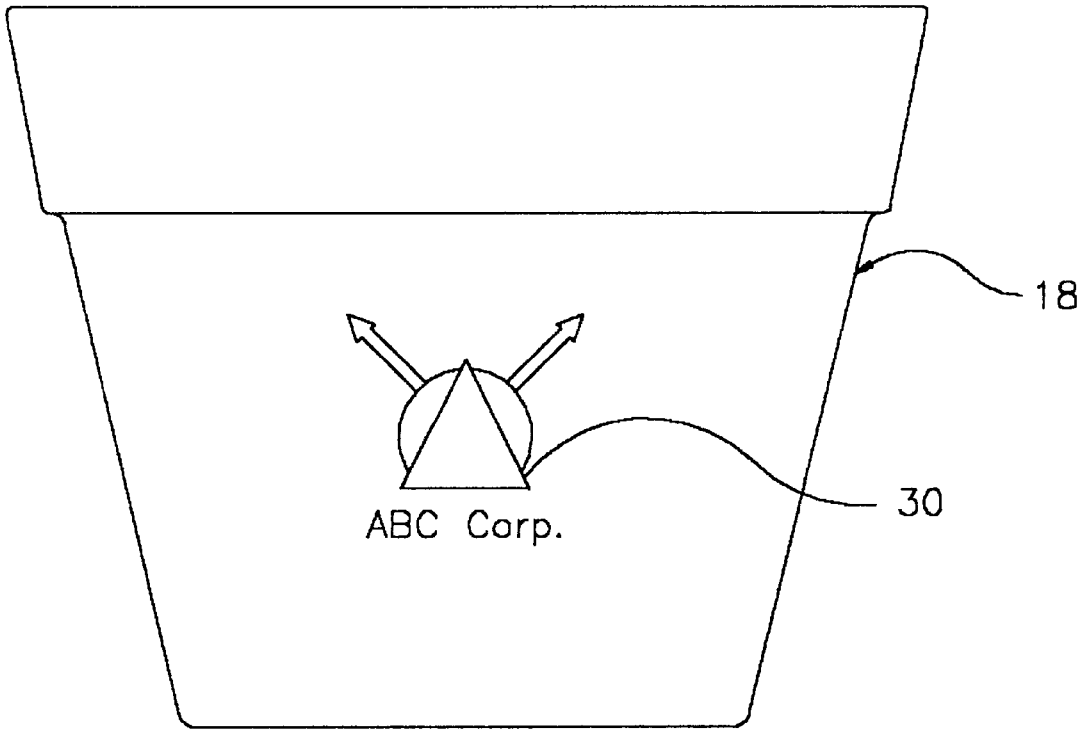
FIG. 3 is a perspective view illustrating a flower pot bearing an image transferred in accordance with the present invention.

Turning now to FIG. 3, flower pot 18 is shown. Here pot 18 has an image 30 positioned on the surface of pot 18 in accordance with the method of the present invention.

In order to accommodate the requirements of a proper image transfer to flower pot 18 and in accordance with the present invention, pot 18 is created in the following manner. A plaster mold or cast of pot 18 is created. A master mold is then created from the cast of flower pot 18.

Flower pot 18 is then created from the master mold. This process produces a pot which will have minimal variations or imperfections in the surface characteristics of flower pot 18. The process of producing a pot from a master mold facilitates the production of numerous pots in which variations and/or imperfections are reduced to a minimum.

For instance, the circumference and surface qualities of both the lower portion and the upper of portion of two pots made from this process are the same. In addition and in accordance with the present invention, there is little variation in characteristics of the clay used, such as water content. It is of particular importance that the shrinkage of pot 18 during manufacture is of a uniform nature with respect to all other pots being produced in accordance with this method. This also adds to the uniformity of flower pot 18. As will be discussed in further detail below, this is of particular importance when heating block 16 is positioned onto the surface of pot 18.

Figure 4:
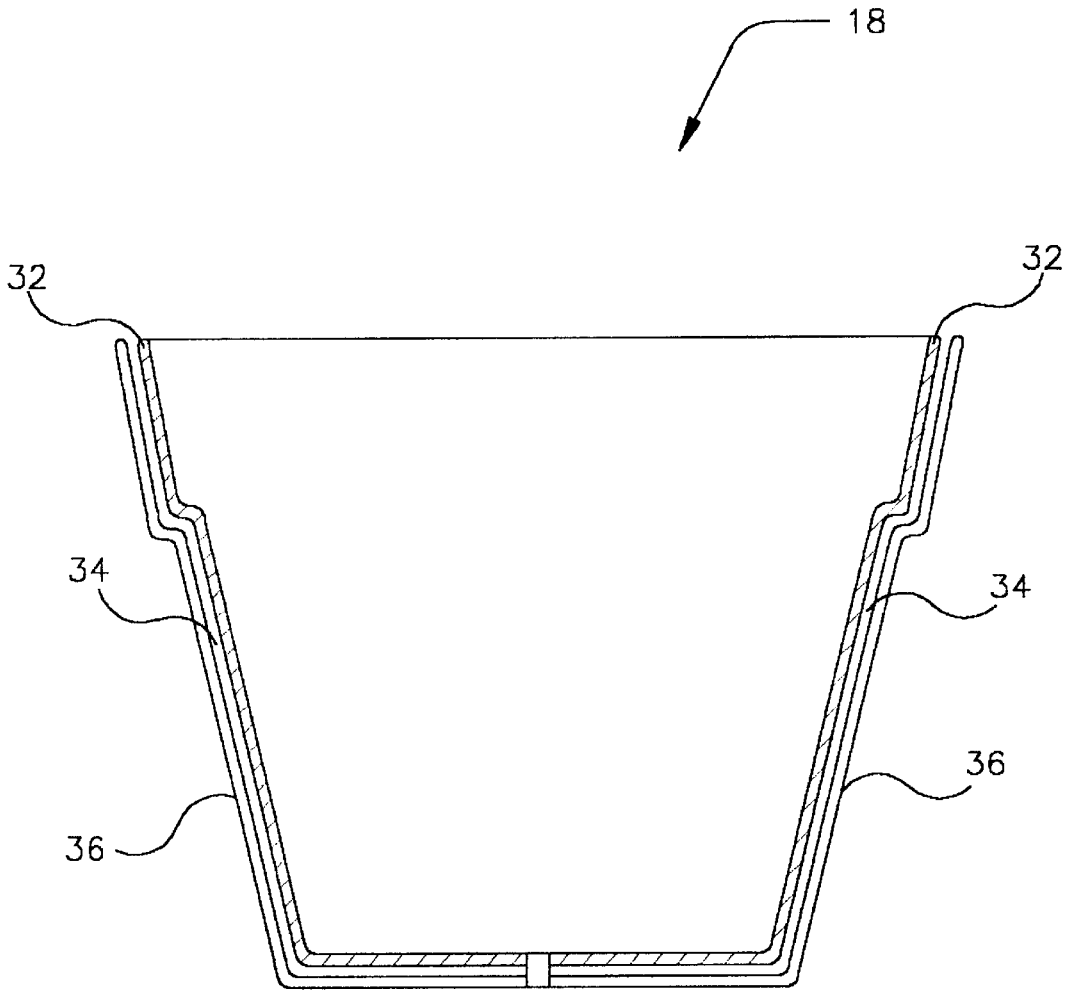
FIG. 4 is a cross sectional view of a finished flower pot such as that illustrated in FIG. 3 and constructed in accordance with the present invention.

Referring now to FIG. 4, a cross sectional view of flower pot 18 illustrates the surface characteristics of flower pot 18 as used in accordance with the present invention. As discussed supra, flower pot 18 is formed out of a clay 32 which is formed and dried in a series of identical plaster casts. After flower pot 18 is formed and dried it is removed from its plaster cast.

The outer surface of pot 18 is now covered with a glazing 34. Once again, particular attention is paid to the amount of glazing applied to the surface of pot 18 to ensure that a uniform coating is applied.

Glazing 34 is applied to the surface of flower pot 18 by passing an inverted flower pot 18 through a flushing machine. This machine allows flower pot 18 to pass through a constant flow of glazing material. This process helps achieve a uniform coating of glazing on the outer surface of pot 18.

Once glazing 34 is adhered to the surface of flower pot 18 the same is placed in a kiln for baking.

Once this process is completed flower pot 18 is now coated with an organic polymer 36. Flower pot 18 is given a uniform coating of organic polymer 36. This coating is approximately 5 microns thick. The thickness and smoothness of organic polymer 36 is of particular importance in that this is the surface image 30 is to be transferred to.

Due to its inherent properties, organic polymer 36 accepts the colors of image 30 particularly well. In addition, organic polymer is extremely durable which in turn also contributes to the durability of image 30.

Referring back now to FIGS. 1 and 1A, image 30 is printed onto a release paper 38. Release paper 38 is typically EPSON photo quality ink jet paper. Image 30 is printed onto release paper 38 with a sublimation inkjet cartridge. Thus, image 30 is printed onto release paper 38 using sublimation ink.

During the heat transfer process, release paper 38 must not be shifted or moved when heating block 16 makes contact with the surface of flower pot 18. To prevent this paper 38 is adhered to the outer surface of pot 18 through the use of a plurality of strips of a heat transfer tape 39. Heat transfer tape 39 is adhered to the periphery of release paper 38 and the surface of pot 18.

Heat transfer tape 39 is resistant to higher temperatures and will not loose its adhesive qualities when it is heated by heat block 16 and its components.

Light spots, blurring or color drop off in image 30 may be caused by movement of the release paper against the surface of the flower pots. Therefore, release paper 38 must be securely positioned over the surface of the flower pot 18 and uniform pressure and heat must be applied to image 30.

Figure 5:
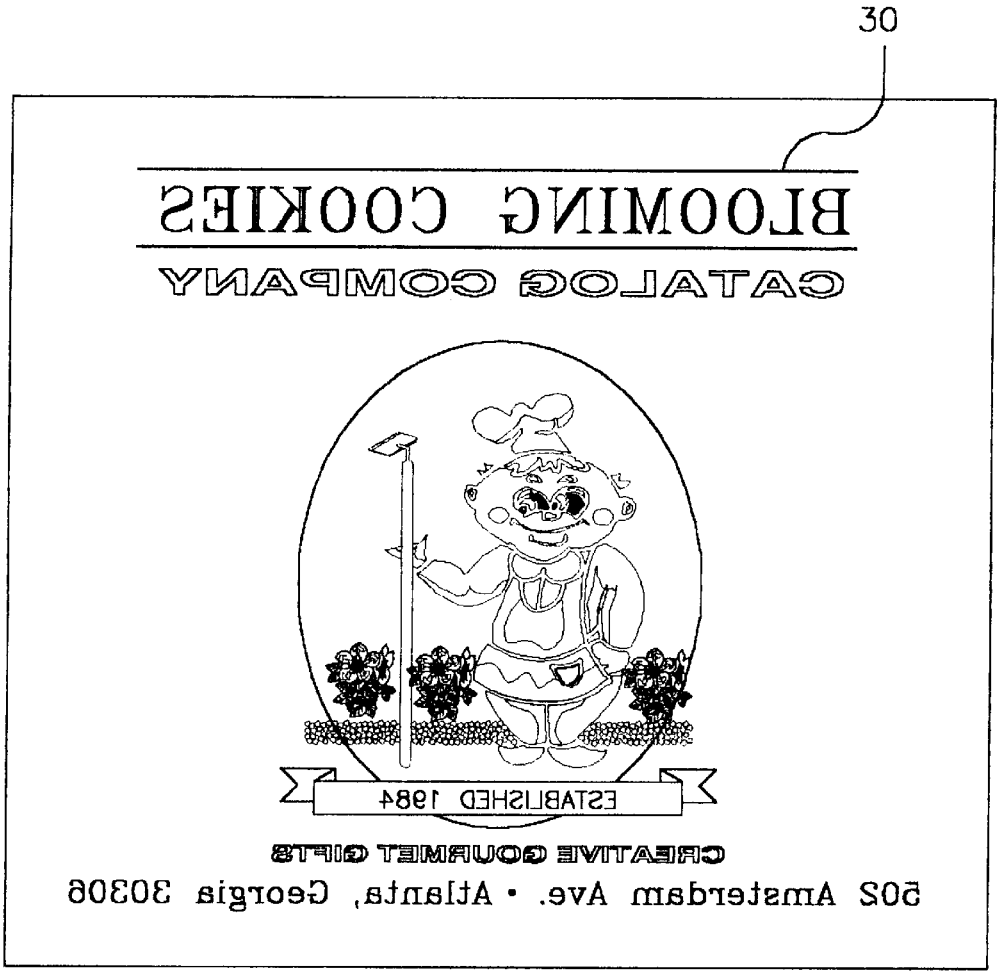
FIG. 5 illustrates the mirror image of an image which one desires to transfer to a flower pot in accordance with the present invention.
Figure 6A:
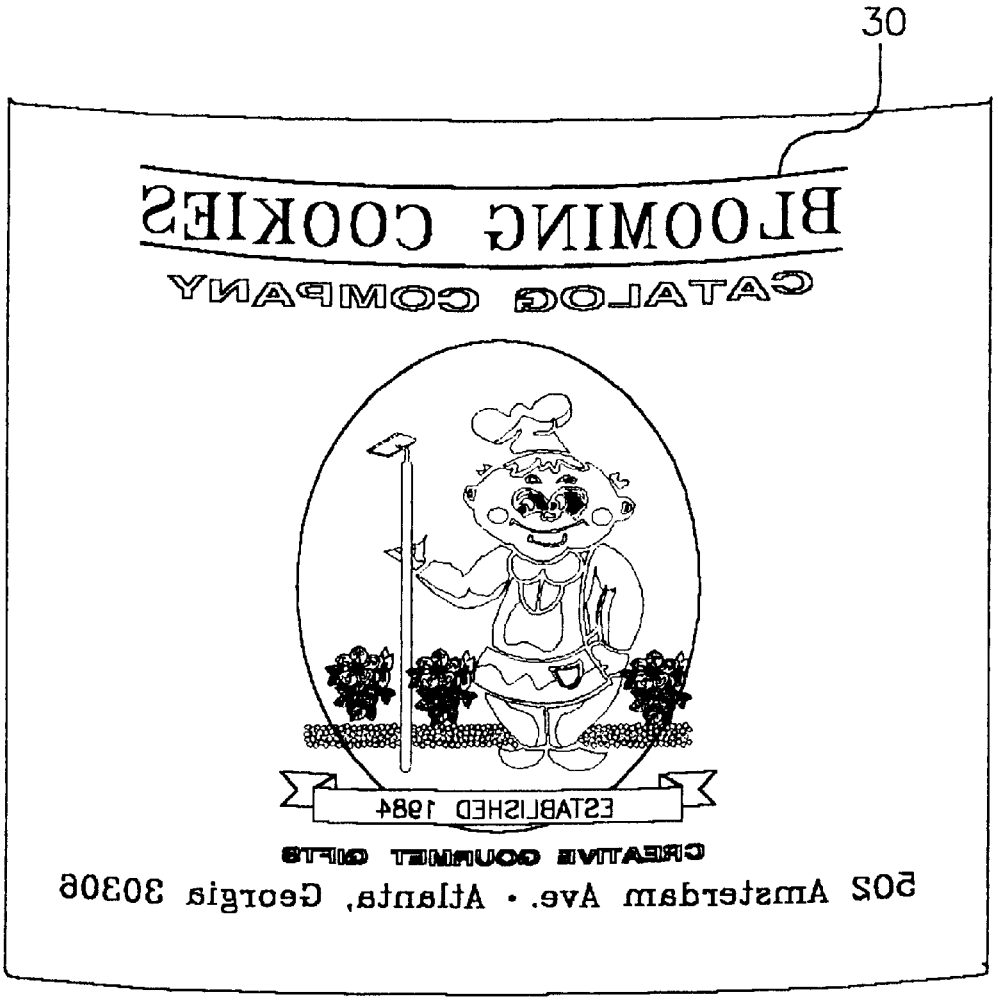
FIG. 6A is a view illustrating a warped version of the image illustrated in FIG. 5 in the form in which it is printed in sublimation ink on a sheet of paper or other carrier for transfer to a flower pot in accordance with the present invention.
Figure 6B:
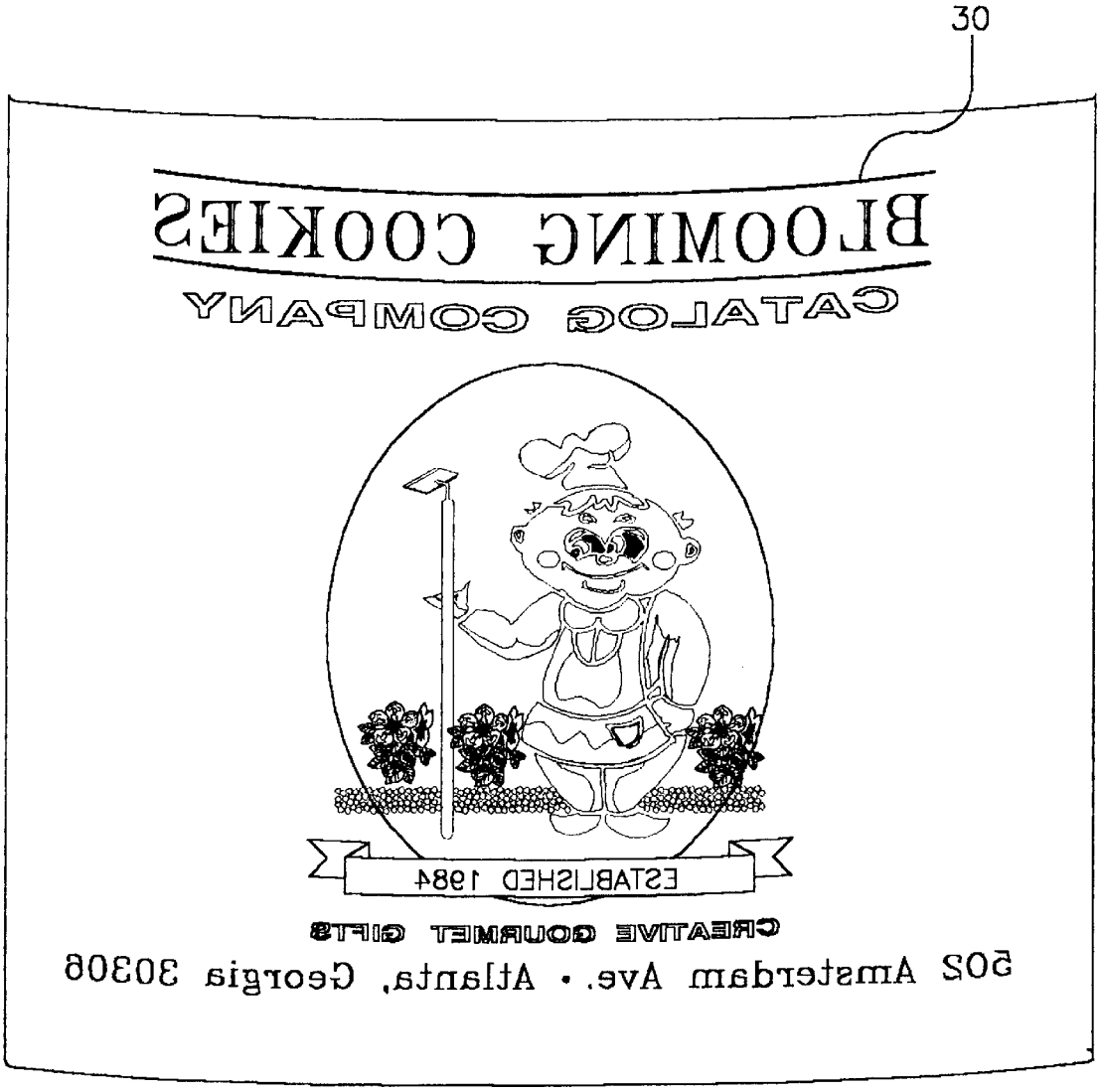
FIG. 6B is an enlarged view of the FIG. 6A image to match the scale of the FIG. 5 image and more particularly illustrate the warping of the image in FIG. 5.

In addition and referring now to FIGS. 5 and 6, image 30 must not only be printed in a reverse mirror fashion to effectuate a proper orientation when it is transferred to the surface of flower pot 18. Image 30 must also be configured or warped to accommodate the conical shape of flower pot 18.

As can be seen from FIGS. 5 and 6, the warped image of FIG. 6 illustrates the warping along the X axis to accommodate the curvature of flower pot 18, as well as the warping along the Y axis to accommodate the conical shape of flower pot 18.

The warping of image 30 is facilitated through the use of computer software which allows the user to manipulate a digital photo, scanned image or any other computer generated image. Thus, an individual can warp the image prior to its printing onto the release paper.

In addition, the warping of image 30 is produced in accordance with the curvature and conical shape of flower pot 18 which has been systematically and uniformly constructed. Thus, the computer software can be preset to warp images in accordance with the uniform characteristics of the surface of pot 18.

Figure 7:
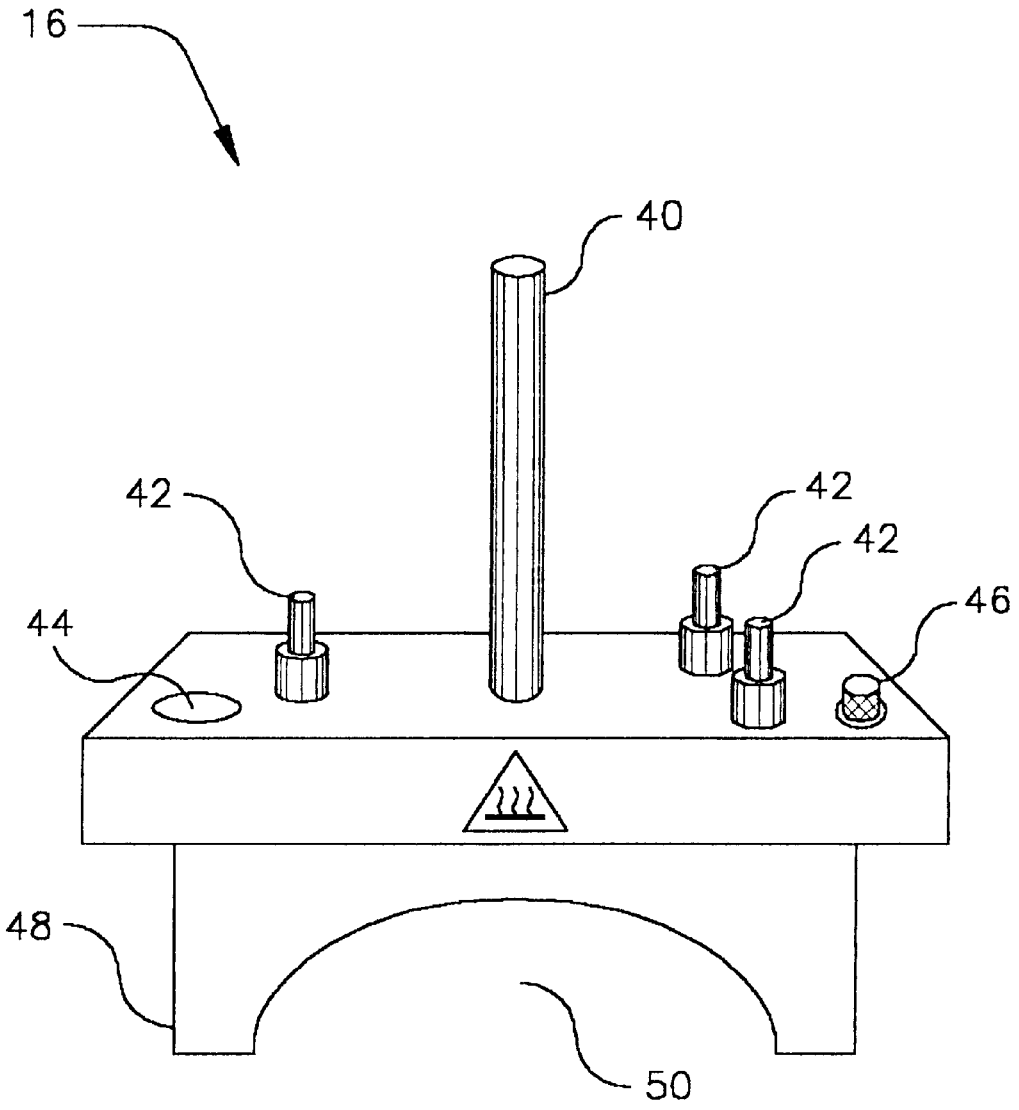
FIG. 7 is a view illustrating the heating block of the present invention.
Figure 8:
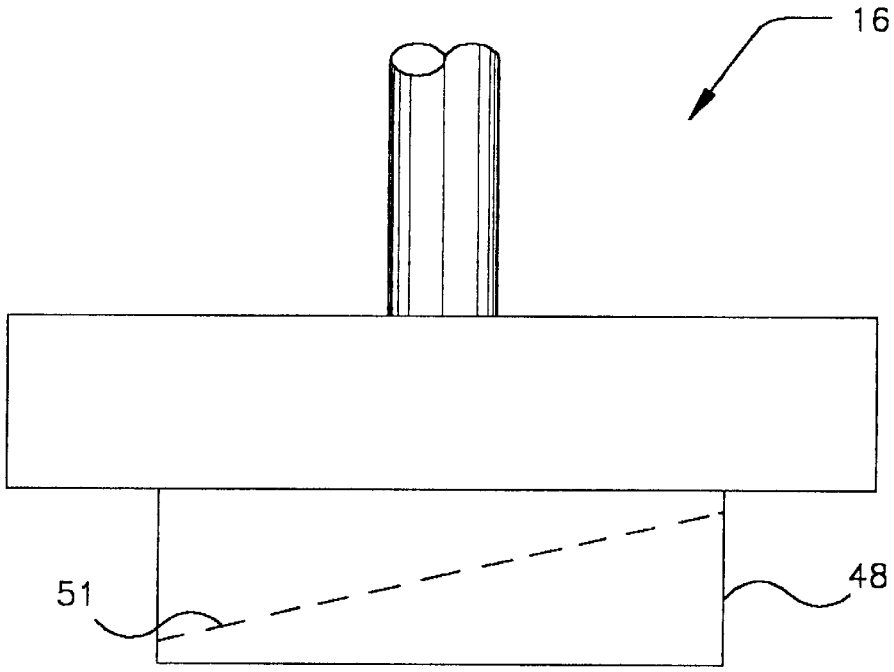
FIG. 8 is a side view illustrating the heating block of the present invention.
Figure 9:
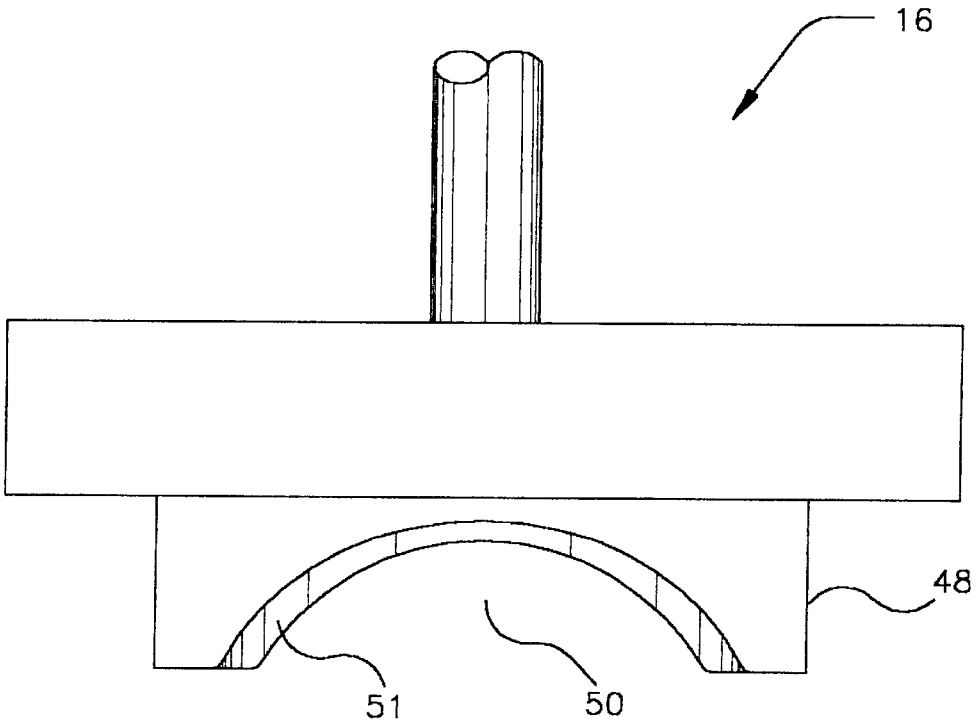
FIG. 9 is a front plane view illustrating the heating block of the present invention.

Turning now to FIGS. 7, 8 and 9, heating block 16 and its components are illustrated. Heating block 16 is equipped with a mounting rod 40 which is connected to the upper surface of block 16. Rod 40 is received into heat press 10 and manipulated by lever 24 to effect the movement of block 16 (as indicated by arrows 26 in FIG. 1).

The lower portion of block 16 has a receiving block 48 positioned on the lower surface of block 16. Receiving block 48 is cast to receive the curved and conical shape flower pot 18 (as illustrated in FIGS. 7, 8 and 9).

Block 48 is produced from a cast taken of pot 18 which is manufactured in accordance with the aforementioned process to produce a plurality of uniform pots. In accordance with the present invention, block 48 is cast to cover approximately 100 degrees of the curvature of flower pot 18. However, block 48 may be configured to cover more or less of the pot's surface. Moreover, the angular configuration of block 48 may also be manipulated.

Receiving block 48 is the portion of heating block 16 that actually makes contact with release paper 38 which is positioned between the surface of flower pot 18 and a receiving area 50 defined with block 48. The inner surface 51 of receiving area 50 is both curved to correspond to the outer circumference of pot 18 and tapered to correspond to the reduced circumference of pot 18 at its lower extremity (ie. conical shape). This is particularly illustrated in FIG. 9.

Receiving area 50 defines an area which has been cast from pot 18 and is configured and dimensioned to match the curvature and the exterior dimensions of pot 18, as discussed above.

Block 48 is cast of Aluminum for its conductive properties which allows for quick heating and cooling of block 48. Block 48 is also cast to match the outer configuration of flower pot 18. The proper mating of flower pot 18 into receiving area 50 is of particular importance in that an improper mating will result in an improper image transfer or an image having faded colors.

When attached to heat press 10, block 48 is heated through a plurality of cal rods 42. Cal rods 42 are electric heating elements which introduce heat to block 16. Cal rods 42 are positioned to provide a uniform heating of block 48. As discussed above uniform heating is of particular importance in sublimation heat transfers.

In accordance with the preferred embodiment heating block 16 is made out of iron while heating block 48 is made out of Aluminum. Heating block 48 is manufactured out of Aluminum due to its conductivity and ease of casting.

Cal rods 42 bring the temperature of block 48 to approximately 400 degrees Fahrenheit, the optimal temperature for the heat transfer process. A temperature gage 44 is positioned on the surface of block 16 to indicated the temperature of block 48. A control knob 46 allows the user to increase of decrease the temperature of block 16.

Accordingly and referring back now to FIG. 1, as heating block 16 is moved towards the surface of flower pot 18, receiving block 48 which has been brought to the optimal transfer temperature, makes contact with release paper 38.

Consequently, the sublimation ink of image 30 is heated up into a gaseous form which allows image 30 to transfer to the surface of pot 18 or more particularly, organic polymer 36.

Image 30 is then transferred to the surface of pot 18 or more particularly to the organic polymer positioned on the surface of pot 18. This process is effectuated by the heat and pressure applied to the surface of pot 18 through the close fit of receiving block 48 and receiving area 50 being configured to receive pot 18.

A digital timer 52 is incorporated into press 10 and positioned so that an operator can be made aware of the time block 48 is in contact with release paper 38 and flower pot 18. Timing is also critical in this process for if image 30 is heated too long or too short imperfections will result.

For example, black colors can turn brown if heated to long and the colors of image 30 may tend to bleed. Image 30 will also appear to be out of focus if it has been heated to long.

The configuration of receiving area 50 to accommodate the conical and circular shape of flower pot 18 allows for a proper image transfer. The uniform consistency of the surface of flower pot 18 and the casting of receiving area 50 also allows for uniform heating and pressure which also adds to the improvement of image quality.

In addition, conventional image transfer presses are unable to accommodate conical configurations.

Moreover, typical conical objects are not covered with organic polymers and are not usually manufactured with such a preciseness to create a smooth surface on a plurality of pots which have uniform characteristics and measurements.

In order to print using the aforementioned heat transfers process, a properly prepared transfer image must be held in tight contact with the receptive surface while heat and pressure is applied. The heat and pressure must continue for a sufficient time to allow the sublimation processes to complete itself.

The present invention wraps around the conical object in receiving area 50 and applies even pressure and heat from all points. This uniform heat and pressure is maintained through the use of a receiving area cast form a pot made in accordance with exacting requirements so as to create a plurality of uniform pots. Moreover, receiving area 50 is cast from Aluminum which allows for uniform heating and ease of casting so as to form a receiving area which will ultimately supply a uniform amount of heat and pressure to release paper 38 which has been positioned between receiving area 50 and the coated surface of pot 18.

If even pressure is not applied, this will tend to create darker images in the areas of high pressure and lighter images in the areas of less pressure.

Thus, the combination of a flower pot 18 having a smooth surface which is substantially identical to any of the flower pots formed through the plaster cast process as discussed above, and the incorporation of a receiving area which has been configured to match such a flower pot, and a supporting structure allows for a pot to receiving area match that until now was unavailable in the heat transfer technology.

While an illustrative embodiment of the invention has been described, various modifications will be obvious to those skilled in the art. Such modifications are within the spirit and scope of the present invention which is limited and defined only by the appended claims.

I claim:

1. The process of transferring a sublimation ink image to the surface of an object comprising the steps of:

(a) forming a plurality of conically shaped objects from a master cast;

(b) coating said objects with an organic polymer;

(c) casting a heat transfer block to match a portion of the exterior surface of said object;

(d) printing an image with a sublimation ink onto a release paper, said image being manipulated to accommodate the configuration of said object;

(e) placing said image on one of said objects; and (f) applying heat and pressure to said image and said release paper through said block to effect the transfer of said image to said object.

2. The process of claim 1, wherein said object is covered with a uniform layer of glazing prior to coating said object with said organic polymer.

3. The process of claim 1, wherein said object is a flower pot and is supported, during the application of heat and pressure, on a sponge positioned on the inside of said object.

4. The process of claim 1, wherein said paper with said image is secured in position with tape.

5. The process of claim 1, wherein said manipulated image is warped along the X axis to accommodate the curvature of the conical object and is warped along the Y axis to accommodate the conical shape of the object.

6. The process of claim 5, wherein said object is a flower pot and is supported, during the application of heat and pressure, on a sponge positioned on the inside of said object, and said paper with said image is secured in position with tape.

7. The process of transferring a sublimation ink image to the surface of an object comprising the steps of:

(a) forming a plurality of conically shaped objects from a master cast;

(b) coating said objects with an organic polymer;

(c) making a heat transfer block to match a portion of the exterior surface of said object;

(d) printing an image with a sublimation ink onto a release paper, said image being manipulated to accommodate the configuration of said objects;

(e) placing said image on one of said object; and (f) applying heat and pressure to said image and said release paper through said block to effect the transfer of said image to said object, wherein said object is a flower pot and is supported, during the application of heat and pressure, on a sponge positioned on the inside of said object.

* * * * *